United States Patent [19]

Reich

[11] 4,345,234

[45] Aug. 17, 1982

[54] MULTIPLE ELEMENT THERMAL ACTUATOR

[75] Inventor: Steven A. Reich, Waterloo, Iowa

[73] Assignee: Deere & Company, Moline, Ill.

[21] Appl. No.: 216,393

[22] Filed: Dec. 15, 1980

[51] Int. Cl.[3] ..... H01H 37/52

[52] U.S. Cl. ..... 337/336; 236/101 R; 337/335; 337/365

[58] Field of Search ..... 337/335, 336, 343, 354, 337/380, 381, 112, 365; 236/87, 101 R, 101 C, 48

[56] References Cited

U.S. PATENT DOCUMENTS

| | | | |
|---|---|---|---|
| 1,645,290 | 10/1927 | Mottlau . | |
| 2,716,683 | 8/1955 | Kathe . | |
| 3,014,342 | 12/1961 | Evans . | |
| 3,131,272 | 4/1964 | Perkins . | |
| 3,712,282 | 1/1973 | Isley | 123/119 CD |
| 4,142,676 | 3/1979 | Hattori | 236/101 R |

FOREIGN PATENT DOCUMENTS

| | | | |
|---|---|---|---|
| 1172386 | 11/1969 | United Kingdom | 337/354 |

OTHER PUBLICATIONS

Crest Manufacturing Company, Inc. Literature.

*Primary Examiner*—Harold Broome

[57] ABSTRACT

A thermal actuator includes a housing containing a stack of deformable discs. A spring maintains a movable follower in engagement with the disc at the end of the stack. At least some of the discs are active snap-acting thermostatic bimetallic discs with first and second structural states wherein those discs are concave in first and second directions at different temperatures. The stack includes a first kind of bimetallic disc which snaps between its structural states at lower transition temperature and a second kind bimetallic disc which snaps between its structural states at a higher transition temperature. The first and second kinds of discs are alternately arranged in the stack. In one embodiment, passive discs which remain in a single structural state are disposed between adjacent pairs of the active discs.

4 Claims, 6 Drawing Figures

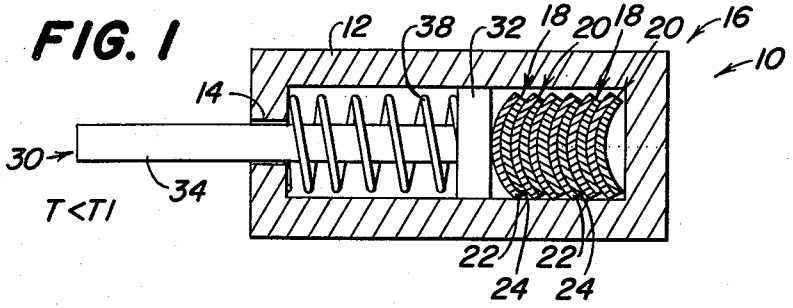
FIG. 1
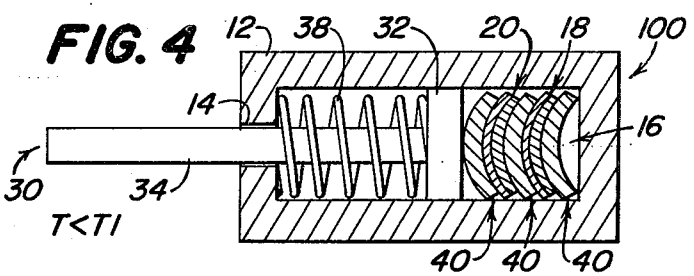
FIG. 4
FIG. 2
FIG. 5
FIG. 3
FIG. 6

MULTIPLE ELEMENT THERMAL ACTUATOR

BACKGROUND OF THE INVENTION

This invention relates to a thermal actuator for producing a controlled displacement of a movable member in response to temperature changes.

Many applications exist for devices which provide a controlled temperature dependent movement of a mechanical member. A thermostatic switch is one example. Another example would be a temperature compensated valve. It is well-known to construct such devices using elements formed out of thermostatic bimetallic material. However, in many such cases, the bimetallic material must be formed into complicated shapes, such as coils or helixes. In other cases, the type of temperature responsive motion provided is limited in complexity. For example, the known devices do not provide for movement to displaced position over a certain temperature range and movement to a retracted position at temperatures both above and below that temperature range. Similarly, the known devices do not provide for multiple step-wise temperature responsive movement. It would be desirable to provide thermal actuators with such temperature responsive movements using low-cost, conventional and easily obtainable thermostatic elements.

SUMMARY OF THE INVENTION

An advantage of the present invention is that it provides a thermal actuator using combinations of conventional bimetallic thermostatic elements.

Another advantage of the present invention is that using only these conventional elements, it provides movement to a displaced position over a certain temperature range and movement to a retracted position at temperatures both above and below that temperature range.

A further advantage of the present invention is that it provides a thermal actuator with multiple step-wise temperature responsive movement.

These and other advantages are achieved by the present thermal actuator which includes a housing containing a stack or a plurality of pre-formed concave disc-shaped members, at least some of which have a pair of temperature dependent structural states wherein they are concave in first and second directions over first and second temperature ranges, respectively. A follower movably supported by the housing is held in engagement with one end of the stack by a spring connected between the follower and the housing. In one embodiment, alternate discs are a first kind of snap acting thermostatic bimetallic member which snap from one to the other of their structural states at a first transistion temperature. The remaining discs are a second kind of bimetallic disc which snap between its structural states at a second and higher transition temperature. In another embodiment, bimetallic discs with differing transition temperatures are separated from each other by passive pre-formed discs which have a single temperature independent deformation state.

BRIEF DESCRIPTION OF THE DRAWINGS

FIGS. 1, 2, and 3 are schematic cross-sectional views of a first embodiment of applicant's invention.

FIGS. 4, 5, and 6 are schematic and cross-sectional views of a second embodiment of applicant's invention.

DETAILED DESCRIPTION

One embodiment of applicant's thermal actuator 10 will now be described with reference to FIGS. 1–3. The thermal actuator 10 includes a cylindrical housing 12 with an opening 14 at one end. The housing 12 should be constructed of a material with relatively high thermal conductivity so that the interior of the housing is maintained nearly at thermal equilibrium with the ambient temperature. If used in a gaseous environment, it might be desirable to provide additional openings (not shown) in the housing 12, so as to more directly expose the interior of the housing 12 to the temperature of the surrounding gaseous environment.

Disposed within the housing 12 is a stack 16 which comprises a plurality of formed members of first and second kinds 18 and 20 alternately arranged. Each of formed members 18 and 20 consist of a conventional snap-acting thermostatic bimetallic disc member, such as made by the Crest Manufacturing Co., Inc. Each bimetallic disc includes bonded first and second metallic layers 22 and 24 having differing coefficients of thermal expansion. Each disc has first and second temperature dependent structural states wherein that disc is either concave to the left or to the right, viewing the figures. In particular, discs 18 are concave to the right below a first transistion temperature T1 (as shown in FIG. 1) and are concave to the left above temperature T1 (as shown in FIGS. 2 and 3). Similarly, discs 20 are concave to the right below a second higher transition temperature T2 (as shown in FIGS. 1 and 2) and are concave to the left above temperature T2 (as shown in FIG. 3). The particular temperature at which each disc snaps between its structural states may be specified when ordering them from the manufacturer.

The actuator 10 also includes a follower 30 having a head 32 engageable with the disc 18 at the end of the stack 16 and having a rod portion 34 slidably received by the housing opening 14. A spring 38 surrounds a portion of the rod 34 and urges the head 32 towards the stack 16 and maintains the head 32 in engagement with the disc 18 at the end of the stack 16. When the ambient temperature is below T1, then all the discs are concave to the right and are in nesting engagement with each other under the influence of the spring urged follower 30, as shown in FIG. 1. If the ambient temperature rises above T1, but remains below T2, then the discs 18 will snap to their concave-to-the-left deformation state. Since the discs 20 are still concave to the right, the discs 18 and 20 are now in non-nesting engagement with each other and the follower is displaced to the left (FIG. 2). When the ambient temperature rises above T2, then discs 20 snap to their concave-to-the-left structural state and the spring urged follower 30 returns to the right to return the discs to nesting engagement with each other. Thus, the position of the follower 30 is indicative of the structural state of the discs 18 and 20, and thus, of the ambient temperature. It should be noted that a larger or smaller number of discs 18 and 20 than the number shown in FIGS. 1–3 could be used to obtain different amounts of follower displacement. The discs 18 and 20 should have a diameter slightly less than the inside diameter of the housing 12 so that the housing 12 does not interfere with the radial expansion of the discs 18 and 20 as they snap between their deformation states.

The embodiment 100 of a thermal actuator shown in FIGS. 4–6 is similar to the one previously described, except that the stack 16 further includes a plurality of passive formed members 40 which have only a single temperature independent structural state wherein all the discs 40 are concave to the right. The passive discs 40 may be constructed of any suitable material which can be pre-formed into a relatively rigid disc with a particular curvature. The passive discs 40 could even be constructed of the previously described bimetallic material, as long as the transition temperature is selected to be outside of the range of ambient temperature to which this second embodiment is to be subjected. In this embodiment, each of the active bimetallic discs 18 and 20 is interposed between adjacent pairs of the passive discs 40. Thus, below temperature T1, all the discs 18, 20 and 40 are in their concave-to-the-right structural states and they are all maintained in nesting engagement with each other by the follower 30, as shown in FIG. 4. When the temperature rises above T1, but remains below T2, only disc 18 snaps to its concave-left structural state, displacing the follower 30 to the left by a predetermined amount and leaving only disc 20 in nesting engagement with its neighboring discs, as shown in FIG. 5. When the ambient temperature rises above T2, then disc 20 also snaps to its concave-left deformation state, displacing follower 30 further to the left and placing all the discs 18, 20 and 40 in non-nesting engagement with each other. Thus, in this embodiment, the displacement of the follower changes in a step-wise manner proportional to the change in ambient temperature. By adding more active discs to the stack which have different transition temperatures, this temperature dependent motion of the follower can be refined or extended. The motion could be refined by adding additional active discs with transition temperatures between temperatures T1 and T2. The motion could be extended by adding more active discs with transition temperatures below temperatures T1 and/or above temperature T2. Similarly, a nonuniform temperature dependent displacement could be obtained by using more than one active disc with a particular transition temperature. However, in each of these cases, each active disc should be separated from the neighboring active discs by at least one of the passive discs 40.

I claim:

1. A thermal actuator comprising:

a housing;

a stack comprising a plurality of formed members disposed within the housing, a portion of the stack comprising at least one formed member having at least a first structural state wherein the at least one formed member is concave in a first direction, the remainder of the stack comprising at least one other formed member having temperature dependent first and second structural states wherein the at least one other formed member is concave in first and second directions, respectively, adjacent formed members of the stack being in nesting engagement with each other over at least one range of ambient temperatures wherein the adjacent formed members are concave in the same direction, adjacent formed members of the stack also being in non-nesting engagement with each other over at least one other range of ambient temperatures wherein the adjacent formed members are concave in opposite directions, the at least one other formed member of the remainder of the stack comprising first and second kinds of snap-acting thermostatic bimetallic members, the first kind snapping from one to the other of its structural states at a first transition temperature, the second kind snapping from one to the other of its structural states at a second transition temperature, the at least one formed member of the portion of the stack comprising a plurality of passive members, each passive member having only a single temperature independent structural state, each bimetallic member being interposed between adjacent pairs of the passive members; and a follower movably supported by the housing, engaging one of the formed members and having a variable position depending upon the temperature dependent structural states of the stack of formed members.

2. A thermal actuator comprising:

a housing;

a stack comprising a plurality of formed members disposed within the housing, a portion of the stack comprising at least one formed member having at least a first structural state wherein the at least one formed member is concave in a first direction, the remainder of the stack comprising at least one other formed member having temperature dependent first and second structural states wherein the at least one other formed member is concave in first and second directions, respectively, adjacent formed members of the stack being in nesting engagement with each other over at least one range of ambient temperatures wherein the adjacent formed members are concave in the same direction, adjacent formed members of the stack also being in non-nesting engagement with each other over at least one other range of ambient temperatures wherein the adjacent formed members are concave in opposite directions, the portion of the stack comprising a plurality of passive members, each passive member having only a single temperature independent structural state, the remainder of the stack comprising a plurality of snap-acting thermostatic bimetallic members interposed between adjacent pairs of the passive members; and a follower movably supported by the housing, engaging one of the formed members and having a variable position depending upon the temperature dependent structural states of the stack of formed members.

3. The thermal actuator of claim 2, wherein the plurality of bimetallic members comprise:

a first kind of bimetallic member which snaps from one to the other of its structural states at a first transition temperature; and a second kind of bimetallic member which snaps from one to the other of its structural states at a second transition temperature.

4. A thermal actuator comprising:

a housing;

a plurality of snap-acting thermostatic bimetallic members disposed within the housing, each bimetallic member having first and second temperature dependent structural states wherein that bimetallic member is concave in first and second directions, respectively, adjacent ones of the bimetallic members being in nesting engagement with each other over at least one range of ambient temperatures wherein the adjacent bimetallic members are concave in the same direction, adjacent ones of the bimetallic members also being in non-nesting engagement with each other over at least one other range of ambient temperatures wherein the adjacent bimetallic members are concave in opposite directions, the plurality of bimetallic members comprising a first kind of bimetallic member which snaps from one to the other of its structural states at a first transition temperature and a second kind of bimetallic member which snaps from one to the other of its structural states at a second transition temperature, the second kind of bimetallic member being adjacent to the bimetallic member of the first kind, the plurality of bimetallic members further comprising a plurality of bimetallic members of the first kind and a plurality of bimetallic members of the second kind; and a follower movably supported by the housing, engaging one of the bimetallic members, and having a variable temperature dependent position depending upon the structural states of the bimetallic members.

* * * * *

Disclaimer 4,345,234.—*Steven A. Reich,* Waterloo, Iowa. MULTIPLE ELEMENT THERMAL ACTUATOR. Patent dated Aug. 17, 1982. Disclaimer filed Dec. 27, 1982, by the assignee, *Deere & Co.*

Hereby enters this disclaimer to all claims of said patent.

[*Official Gazette July 12, 1983.*]